US009120327B2

(12) United States Patent
Starkey

(10) Patent No.: US 9,120,327 B2
(45) Date of Patent: Sep. 1, 2015

(54) TAPE DRIVE AND METHOD OF OPERATING A TAPE DRIVE

(71) Applicant: Markem-Imaje Industries Limited, Nottingham (GB)

(72) Inventor: Simon Starkey, Leicestershire (GB)

(73) Assignee: Markem-Imaje Industries Limited, Nottingham (GB)

( * ) Notice: Subject to any disclaimer, the term of this patent is extended or adjusted under 35 U.S.C. 154(b) by 0 days.

(21) Appl. No.: 14/242,422

(22) Filed: Apr. 1, 2014

(65) Prior Publication Data

US 2014/0300680 A1 Oct. 9, 2014

(30) Foreign Application Priority Data

Apr. 3, 2013 (GB) ..... 1306022.3

(51) Int. Cl.

| | |
|---|---|
| ***B41J 2/325*** | (2006.01) |
| ***B41J 35/36*** | (2006.01) |
| ***B41J 17/36*** | (2006.01) |
| ***B41J 33/14*** | (2006.01) |

(52) U.S. Cl.
CPC *B41J 2/325* (2013.01); *B41J 17/36* (2013.01); *B41J 33/14* (2013.01); *B41J 35/36* (2013.01)

(58) Field of Classification Search
CPC ..... B41J 2/325; B41J 17/32; B41J 29/38; B41J 3/4075
USPC ..... 347/214, 217, 19
See application file for complete search history.

(56) References Cited

U.S. PATENT DOCUMENTS

| | | | | |
|---|---|---|---|---|
| 5,185,315 | A * | 2/1993 | Sparer | 503/227 |
| 5,305,020 | A | 4/1994 | Gibbons | |
| 5,445,463 | A | 8/1995 | Paranjpe | |
| 5,455,617 | A | 10/1995 | Stephenson | |
| 5,853,255 | A * | 12/1998 | Soshi et al. | 400/237 |
| 8,412,062 | B2 * | 4/2013 | Kielland | 399/45 |
| 2002/0181990 | A1 | 12/2002 | Richard | |
| 2004/0165025 | A1 * | 8/2004 | Ishibashi et al. | 347/19 |
| 2007/0182807 | A1 | 8/2007 | Sawada | |
| 2008/0219742 | A1 * | 9/2008 | McNestry et al. | 400/234 |
| 2009/0033581 | A1 | 2/2009 | Ross | |

FOREIGN PATENT DOCUMENTS

EP 0979735 B1 10/2005

* cited by examiner

*Primary Examiner* — Sarah Al Hashimi
(74) *Attorney, Agent, or Firm* — Fish & Richardson P.C.

(57) ABSTRACT

A tape drive for transferring tape between a first spool and a second spool, the tape comprising at least one marker indicative of a property of the tape, the tape drive having: two spool supports, each of which is suitable for supporting a spool of tape, and a tape control system which includes: two motors and a controller for controlling the operation of the motors, each motor driving a respective one of the spool supports, and a detector that is operable, in use, to detect the presence of one or more markers on a portion of a tape, the tape control system being operable to identify a property of the tape according to the detected marker or markers.

22 Claims, 3 Drawing Sheets

TAPE DRIVE AND METHOD OF OPERATING A TAPE DRIVE

CROSS-REFERENCE TO RELATED APPLICATIONS

This application claims the benefit of priority under 35 U.S.C. §119 of United Kingdom Patent Application No. 1306022.3, filed Apr. 3, 2013, which is incorporated herein by reference.

BACKGROUND

This invention relates to a tape drive including a detector for identifying properties of a tape in the tape drive, and to a tape, and to a method of operating a tape drive.

The invention is useful in relation to a printing apparatus which uses a printing tape or "ribbon" which includes a web carrying marking medium, e.g. ink, and a printhead which, in use, removes marking medium from selected areas of the web to transfer the marking medium to a substrate to form an image, such as a picture or text.

More particularly, but not exclusively, the invention relates to a so called thermal transfer printing apparatus in which the printhead includes a plurality of thermal heating elements which are selectively energisable by a controller during printing to warm and soften pixels of ink from the tape and to transfer such pixels to the substrate. The printhead presses the tape against the substrate such that the pixels of ink contact the substrate before the web of the tape is peeled away, thus transferring the pixels of ink from the tape to the substrate.

Such printing apparatus includes drive apparatus for moving the tape relative to the printhead, to present fresh tape, from which pixels of ink are yet to be removed, to the printhead, such that successive printing operations can be carried out. By enabling such movement and selectively energising the printing elements in each of a plurality of positions along the substrate and tape, a desired image can be built up from printed dots.

Tape drives used in such printing apparatus typically include two spool supports, one of which supports a supply spool on which unused tape is initially wound and the other of which supports a take-up spool, onto which the tape is wound after it has been used. Tape extends between the spools in a tape path. Each of the spool supports, and hence each of the spools, is driveable by a respective motor.

Various types of tape drive have been proposed, and for the purposes of the present invention, the type of tape drive which is used is not important.

It is known to provide thermal transfer printing apparatus in two different configurations. In the first, so called "intermittent" configuration, the substrate to be printed and the tape are held stationary during a printing operation, whilst the printhead is moved across the area of the substrate to be printed. Once the printing operation is complete, the printhead is lifted away from the tape, and the tape is advanced to present a fresh region of tape to the printhead for the next printing operation.

In the second, so called "continuous" configuration, the substrate to be printed moves substantially continuously and the tape is accelerated to match the speed of the substrate before the printhead is brought into thermal contact with the tape and the printing operation is carried out. In this configuration, the printhead is maintained generally stationary during each printing operation.

SUMMARY

The present invention is suitable for use in printing apparatus which operates in either intermittent or continuous configurations, or which is switchable between configurations.

It is known to provide different tape drive settings to accommodate different types of tape. For example, thermal transfer ribbon is available with many different ink formulations as well as different widths and lengths. The printing apparatus using the ribbon must be set up accordingly, to enable the print process to be controlled correctly and optimally. For example, the ribbon thickness may change dependent on ink type. The ribbon thickness is important to the operation of the printing apparatus since it determines how the diameters of the ribbon spools change as tape passes from the unused ribbon spool to the used ribbon spool.

Similarly the amount of heat output from the thermal printhead is altered dependent upon the type of ink on the ribbon. Different types of ink are used dependent upon the target material on which the printing apparatus is printing. Inks which are typically carried on a wax medium require less heat than inks based on a resin medium.

Known printing apparatus require the operator to identify the ribbon being used and enter its characteristics into the printing apparatus correctly. Some printing apparatus simplify this task by using ribbon part numbers, requiring the printing apparatus to have knowledge of the characteristics associated with the ribbon defined by the part number. Therefore it is advantageous to the operation of the printing apparatus for the ribbon to contain a mechanism which allows the ribbon to be automatically identified by the printing apparatus. Thermal transfer ribbons are typically supplied wound on a core with no additional casing or packaging around the ribbon when the ribbon is fitted to the printing apparatus. This limits the possibility for identification marks which may be recognised by the printing apparatus.

EP0979735 describes a possible use of RFID tagging within a ribbon core. However, such technology is very difficult to implement within thermal transfer printing apparatus since the movement of the cores makes antenna location difficult. US2009-0033581 describes a possible antenna design for detecting and reading an RFID tag. However, it is important that any mechanism used should not affect the operation of the ribbon (at least so as to prevent any substantial effect on the movement of the ribbon) within the printing apparatus.

According to an aspect of the invention, there is provided a tape drive for transferring tape between a first spool and a second spool, the tape including at least one marker indicative of a property of the tape, the tape drive having: two spool supports, each of which is suitable for supporting a spool of tape, and a tape control system for transferring tape between the spools, including a detector that is operable, in use, to detect the presence of a marker on a portion of a tape as the tape is moved past the detector, the tape control system being operable to identify a property of the tape according to a detected marker.

The detector may be operable to detect a plurality of markers on a tape. The tape control system may be operable to identify a pattern of markers on a tape. The tape control system may be operable to identify a pattern defined by the presence or absence of markers at predefined intervals on a tape.

The tape control system may be operable to identify a pattern defined by the length of one or more markers on a tape. The tape control system may be operable to identify a pattern defined by the spacing between markers on a tape. The tape control system may use information relating to the movement of the tape in combination with information obtained by the detector relating to a marker or a pattern of markers, in order to identify a property of the tape.

The detector may include: an emission source configured to emit electromagnetic radiation; and a marker sensor which is configured to receive a signal indicative of whether a marker has responded to emitted radiation, indicating that a marker is present on a tape at a location adjacent the detector. The radiation emitted by the emission source may be polarised. The marker sensor may be configured to receive a signal that is transmitted, reflected, or emitted by a marker on a tape.

The tape control system may be operable to identify a code corresponding to a pattern of markers detected by the detector. The tape control system may be operable to identify a binary code. The pattern of markers may include the lengths of markers. The pattern of markers may include the spacing between markers. The pattern of markers may include the presence or absence of markers at predetermined intervals along a portion of the length of the tape.

The tape control system may be operable to identify a property of the tape based on the identified code. The tape control system may include a database storing a plurality of codes and associated tape properties.

According to a second aspect of the invention, there is provided a printing apparatus including a tape drive according to the first aspect of the invention.

According to a third aspect of the invention, there is provided a tape for use in a printing apparatus according to the second aspect of the invention, the tape having an ink layer on a first side, wherein the tape includes at least one marker indicative of a property of the tape.

The marker may be provided on the first, inked side of the tape, or on a second, non-inked side of the tape. The marker may be formed as a band across the width of the tape. The tape may include a plurality of markers.

The plurality of markers may define a pattern corresponding to a predefined code. The pattern may be repeated at intervals along the length of the tape. The or each marker may be provided on an edge of the tape.

According to a fourth aspect of the invention, there is provided a spool of tape including a tape according to the third aspect of the invention wound on a core to form a spool, for use in a printing apparatus. A plurality of markers may be provided in radial bands extending between the core and a perimeter of the spool.

According to a fifth aspect of the invention, there is provided a method of operating a tape drive according to the first aspect of the invention, including: positioning first and second tape spools on respective first and second spool supports, operating the detector so as to detect the presence of a marker on a portion of the tape, identifying a property of the tape according to the detected marker; and operating the tape control system in accordance with the identified property of the tape.

Operating the detector may include: operating an emission source to emit electromagnetic radiation; and operating a marker sensor to receive a signal indicative of whether a marker is present at a particular location on a tape.

Operating the detector so as to detect the presence of a marker on a portion of the tape may include repeatedly operating the detector to detect a plurality of markers on a portion of the tape.

The method may further include identifying a pattern of markers on the tape, and using information about the movement of the tape provided by the tape control system in combination with the identified pattern to determine a property of the tape. Identifying a property of the tape may include identifying a code indicated by the pattern of markers on the tape.

Operating the tape control system in accordance with the identified property of the tape may include adjusting one or more settings of the tape drive. Operating the tape control system in accordance with the identified property of the tape may include providing an error message. Operating the tape control system in accordance with the identified property of the tape may include requiring operator intervention to accept the tape type.

Operating the tape control system in accordance with the identified property of the tape may include reducing the power applied to the printhead to prevent damage. Operating the tape control system in accordance with the identified property of the tape may include deactivating the tape drive.

BRIEF DESCRIPTION OF THE DRAWINGS

The invention will now be described, by way of example only, with reference to the accompanying drawings, of which.

DETAILED DESCRIPTION

Figure 1:
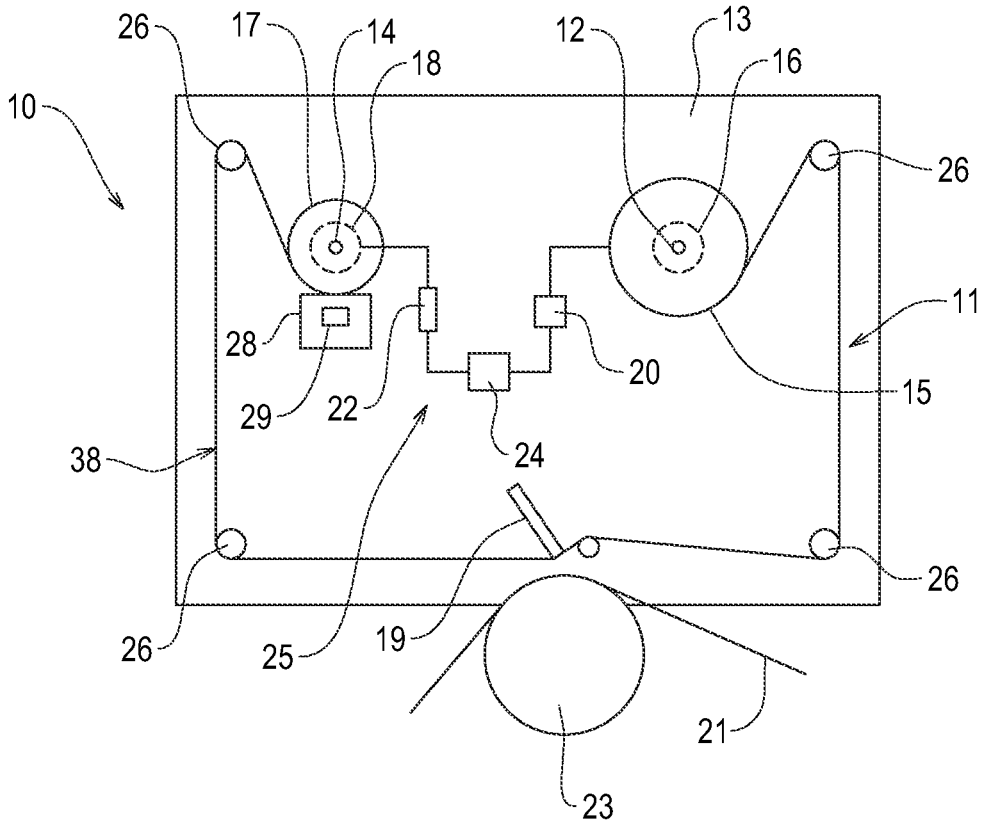
FIG. 1 is an illustrative view of part of a thermal printing apparatus including a detector according to the present invention.

With reference to FIG. 1, a part of a printing apparatus 10 is shown. The printing apparatus 10 includes a tape drive shown generally at 11. The printing apparatus includes a housing 13, in or on which is mounted a first spool support 12 and a second spool support 14, which form part of the tape drive 11. The spool supports 12, 14 are spaced laterally from one another.

In use, a supply spool 17, upon which unused tape 38 is wound, is mounted on the spool support 14, and a take up spool 15, upon which used tape 38 is wound, is mounted on the spool support 12. The tape 38 generally advances in a tape path between the supply spool 17 towards the take up spool 15. The tape 38 is guided in the tape path between the spools 15, 17 adjacent the printhead 19 by guide members 26. The printing apparatus 10 also includes a printhead 19 for transferring ink from the tape to a substrate 21 which is entrained around a roller 23 adjacent the printhead 19. Depending upon the configuration of the printing apparatus, the substrate 21 may be positioned adjacent the printhead 19 on a platen, rather than a roller.

Each of the spool supports 12, 14 is independently drivable by a respective motor 16, 18. In the present example, each of the motors 16, 18 is a brushless DC motor. Each of the spool supports 12, 14 is rotatable clockwise and anti-clockwise by means of its respective motor 16, 18. Each motor 16, 18 is electrically connected to a controller 24 via a rotor sensor 20, 22. This rotor sensor 20, 22 is typically a rotary encoder although it will be appreciated that other technologies are also acceptable. The controller 24 is operable to control the mode of operation of each of the motors 16, 18 and the amount of drive provided by each of the motors 16, 18. The position of the controller 24 relative to the remainder of the printing apparatus 10 is irrelevant for the purposes of the present invention. Each rotor sensor 20, 22 enables the controller 24 to determine the angular position and rotational speed of a rotor of the respective motor 16, 18. The motors 16, 18, the rotor sensors 20, 22 and the controller 24 all form part of a motor control system 25. The features of the motor control system 25 described herein are intended to be exemplary, and it will be appreciated that alternative motor control systems are compatible with the invention.

Figure 5:
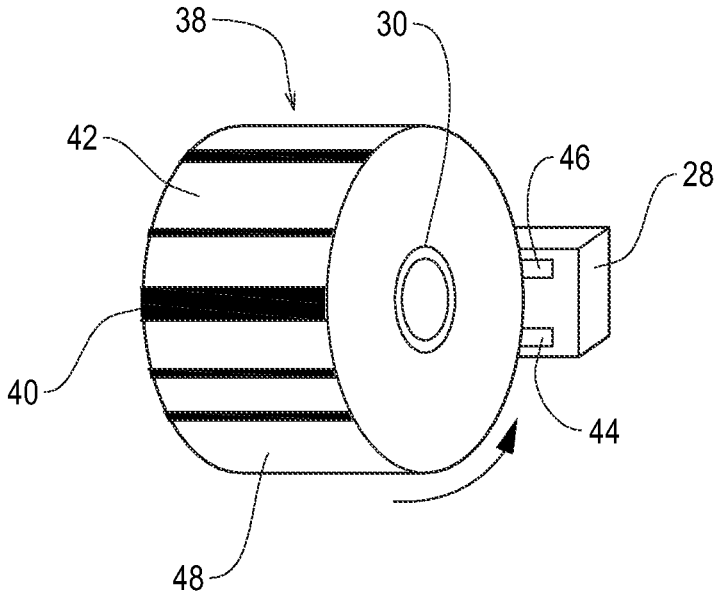
FIG. 5 is an illustrative perspective view of a detector shown adjacent a face of a spool of ribbon.
Figure 6:
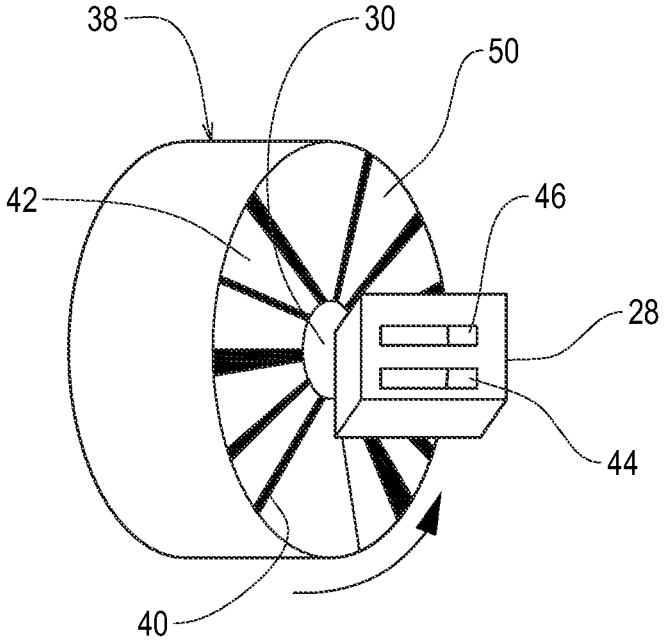
FIG. 6 is an illustrative perspective view of a detector shown adjacent an edge of a ribbon.

The motor control system 25 forms part of a tape control system, which also includes a detector 28 as shown in FIGS. 5 and 6, and may also include a separate controller (not shown) for receiving inputs from the detector and communicating with the controller 24 of the motor control system 25.

The detector 28 is provided within the housing 13, and includes a marker sensor 46 for detecting markers 40 provided on the tape 38, and an emission source 44 configured to emit a signal to enable detection of the markers 40. The marker sensor 46 is configured to receive a signal indicative of whether a marker 40 is present at a particular location on the tape 38. The marker sensor 46 is configured to receive a signal from a selected portion of the tape, for example the portion of the tape nearest the detector, whilst disregarding the presence of other markers which are on other parts of the tape.

The detector 28 is located adjacent one of the spool supports 12, 14 such that the marker sensor 46 is able to receive a signal corresponding to the signal emitted by the emission source 44, reflected, emitted or otherwise transmitted, from the tape 38. In FIG. 1, the detector 28 is shown located adjacent the spool support 14, so that when the supply spool 17 is mounted on the spool support 14, the marker sensor 46 of the detector 28 is able to detect the presence of markers 40 on the tape 38. References to detecting the presence of a marker 40 on a portion of the tape 38 also apply to detection of the absence of a marker 40 on that portion of the tape 38—in other words, the marker sensor 46 can detect whether a marker 40 is present or not at a point on the tape 38.

Figure 2:
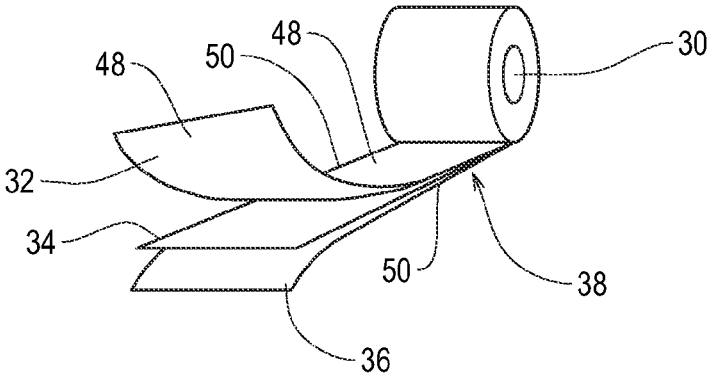
FIG. 2 is an illustrative view of a spool of tape.

Thermal transfer ribbon 38 is typically supplied wound on a core 30, as shown in FIG. 2, for example. When unwound, each length of tape 38 is formed of multiple substantially flat, planar layers, each layer having a first and a second 'face' (i.e. the two opposing flat surfaces of the layer separated by the 'thickness' of the layer) and a pair of edges disposed on opposing sides of the layer, separated across the 'width' of the layer, transverse to the length of the tape. In the example shown, the tape 38 includes three principal layers: a carrier 34 (or web) which provides the mechanical structure of the ribbon; an ink layer 36 on one side of the carrier 34; and a low friction layer 32 on the other side of the carrier 34. The low friction layer 32 provides a surface with a lower frictional coefficient than the carrier 34, thus enabling smooth movement of the printhead 19 relative to the ribbon 38. The carrier 34 is typically thin to allow the heat from the printhead 19 to pass through it.

Tape 38 is supplied wound on a core 30 with either the ink layer 36 on the outside of the spool 15, 17 or the low friction layer 32 on the outside of the spool 15, 17. The tape includes a plurality of markers 40. Each marker 40 is a chemical marker which is applied to the tape 38.

Figure 4:
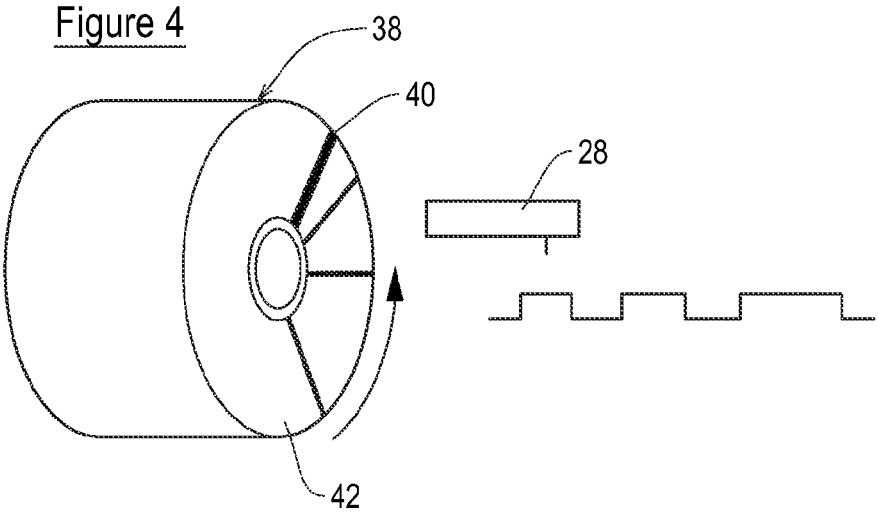
FIG. 4 is an illustrative view of a reel of tape, showing the location of markers on an edge of the tape.

When wound on a core 30, to form a spool 15, 17, each edge 50 of the tape 38 forms a substantially annular surface on which one or more markers 40 may be provided, as shown in FIG. 4, for example. In such a configuration, the markers 40 are provided in radial bands extending between the core 30 and a perimeter of the spool 15, 17, in which case the markers 40 are said to be provided on the edge 50 of the tape 38.

Figure 3:
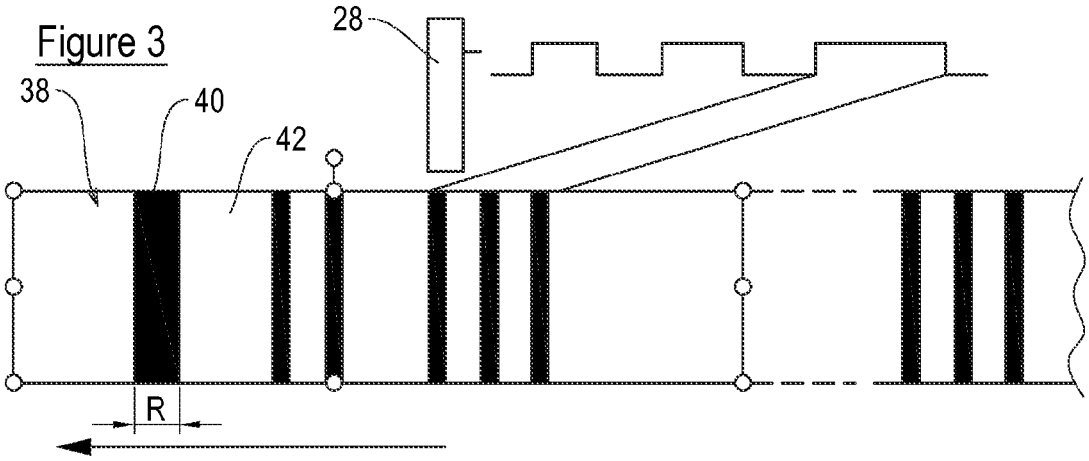
FIG. 3 is an illustrative view of a portion of a tape, showing the location of markers on a face of the tape.

Additionally, or alternatively, one or more markers 40 may be provided on a face 48 of a tape 38. For example the markers 40 may be incorporated in the low friction layer 32 of the tape 38. Additionally or alternatively, each marker 40 extends laterally across the width of the carrier layer 34, between the edges of the carrier layer 34, as shown in FIG. 3. Where the markers 40 are provided on the carrier layer 34, the markers 40 are detectable through the low friction layer 32, and such a configuration is also included in references to markers 40 being provided on a 'face' 48 of the tape 38. It will be appreciated that each marker need not extend across the entire width of the tape 38.

The markers 40 of any embodiment described above may be provided in a predefined pattern.

The detector 28 is configured such that, in use, the marker sensor 46 is positioned substantially adjacent the tape 38 so that the marker sensor 46 is able to detect markers 40 on a face 48 of the tape 38 as the tape moves past the detector 28. In such embodiments, the marker sensor 46 is positioned so that it is directed towards a face 48 of the tape 38. Alternatively, the marker sensor 46 may be positioned so that it is able to detect markings 40 on the edge 50 of the tape 38. The marker sensor 46 is positioned so that in use it is adjacent a face 48 or an edge 50 of the tape 38, respectively, so as to receive signals which are indicative of the presence (or absence) of a marker 40.

Alternatively, the detector 28 may be positioned remote from the spool supports 12, 14, and disposed at any location on the tape path such that the marker sensor 46 is able to detect markings on the face 48 and/or the edge 50 of the tape 38 as the tape moves past the detector 28.

In all embodiments, the detector 28 is positioned so that it does not interfere with the operation of the tape drive 11, at least to any substantial degree.

In use, the tape drive 11 of the printing apparatus 10 typically winds the ribbon 38 forwards during its initial loading of the ribbon 38. A portion of the ribbon 38 is moved past the detector 28 at a rate controlled by the tape drive 11. The emission source 44 emits a signal towards that portion of the ribbon 38, so that as the markers 40 pass the detector 28, the marker sensor 46 receives a signal indicative of whether a marker 40 is present on that portion of the ribbon 38. The signal may be reflected by the tape 38, or emitted by the tape 38 in response to the signal emitted by the emission source 44 of the detector 28.

The signal emitted by the emission source 44 of the detector 28 is electromagnetic radiation. In a first example, the radiation has a wavelength between 10 nm and 400 nm (i.e. ultraviolet (UV) light). The tape 38 includes corresponding chemical markers 40 which fluoresce under UV light, for example, and are "triggered" by the emission of UV light from the emission source 44. The marker sensor 46 receives the fluorescing signal, and thereby detects the presence of one or more markers 40 on that particular portion of the tape 38.

In a second example, the emission source 44 emits infrared radiation, and the markers 40 on the tape 38 respond to infrared radiation, for example, by fluorescing.

In a third example, the emission source 44 emits polarised light, and the markers 40 respond to a predetermined radiation pattern defined by the particular polarisation.

It must be appreciated that this invention is not restricted to these three forms of marker. In general the marker will respond to some form of incident electromagnetic radiation from the emission source 44 in a manner that can be detected by the detector 28 as the marked portion of the tape 38 passes the detector 28.

The tape control system is operable to determine information about the ribbon 38 via the detector 28, and to influence operation of the tape drive controller 24. The signal received by the marker sensor 46 is preferably a serial digital signal, and this signal is communicated to and decoded by the controller to which the detector 28 is communicatively coupled within the tape control system. However, it should be understood that once the detector 28 has detected the presence, or absence, of one or more markers 40 on the tape 38, the identification of a pattern and subsequent identification of a code represented by the pattern may take place at the detector 28, at a controller within the tape control system, or at a combination of those locations.

Since the tape drive 11 controls the speed of the ribbon 38 as it passes the detector 28, the controller 24 is operable to calculate the distance travelled by the tape 38. This additional information may be used to validate the signal received from the detector 28, by ensuring that the distance travelled by the tape 38 corresponds to the length of tape known to contain a complete code, for example. The distance travelled by the tape 38 may also be used to calculate the distance between (and width of) the markers 40, and/or the separation distance between adjacent markers 40. The calculations to determine the distance between and width of the markers 40 may also take into consideration the diameter of each of the spools 15, 17. In embodiments in which the detector 28, and particularly the marker sensor 46, is located adjacent the edge of the tape 38 so as to detect markers 40 on the edge 50 of the spool 15, 17, for example, the measured width of the markers 40 and space between markers 40 may be measured as a proportion of the diameter (or radius, or circumference) of the spool 15, 17 at the point of detection.

The pattern of markers 40 is identified by the detector 28 and/or the control system as a code, which in turn may indicate a property of the ribbon 38. For example, the code may indicate one or more of: the thickness of the tape 38, the width of the tape 38, the manufacturer of the tape 38, a serial number associated with the tape 38, the printing apparatus 10 with which the tape spool 15, 17 is intended to be used, one or more properties of the ink layer 36, the length of tape 38 on the reel, a desired printing apparatus or tape drive setting associated with the tape 38, or any other property of the tape 38.

The markers 40 are preferably applied to the tape 38 using a "hidden mechanism" to inhibit the production of counterfeit ribbon spools 15, 17. For example, markers 40 may be applied using a chemical agent that responds to a predetermined radiation pattern such as polarised light. Since the markers 40 respond only to a carefully defined 'triggering' condition (i.e. the reception of light polarised in that particular way), the presence of the markers 40 may be hidden from view when the ribbon spool 15, 17 is not in use (i.e. when it is not installed in the printing apparatus 10), and only detectable when in proximity to the emission source 46 within the printing apparatus 10 and moved past the detector 28 by the tape drive 11. In this way, the markers 40 may not be apparent to a user of the printing apparatus 10, who need not be aware of their existence.

The pattern of the markers 40 may represent an n bit binary code (i.e. as a digital signal, as shown in FIGS. 3 and 4 of the drawings). The detector 28 operates the emission source 46, and samples the marker sensor 46 at pre-determined distances of ribbon travel to determine whether a marker 40 is present or not at that particular portion of the ribbon 38. The presence of a marker corresponds to a '1' and the absence of a marker corresponds to a '0' of the binary code (or vice versa). The start of the code is indicated by an unmarked portion 42 of tape 38, followed by a band of marker 40 indicating the start of a code, although it is contemplated that other patterns may be used to indicate the start of a code.

Once the controller has read n bits of information (where n is a predefined value stored by the detector and/or control system) and that information has been detected over the correct distance of ribbon travel, the control system determines a binary code corresponding to the markers that have been identified. This code can then be used to identify the ribbon 38, or properties of the ribbon 38. The code may provide an index for a table of ribbon types or properties supported by the printing apparatus 10. The code may include error detection and correction bits to ensure a valid pattern is read, such as the use of one or more of: a parity bit, a checksum test, and sequence repetition (i.e. repeating the code multiple times to check for consistent detection).

A code other than a binary code may be detected. For example, in embodiments in which the markers 40 include 'bands' each formed across the width of the tape 38 and each having a length l (see FIG. 3) in the direction of the length of the tape 38, additional information may be obtained from the length of bands, and spacing between consecutive bands. A code may be identified from one or more of: the lengths l of one or more markers 40, the lengths of unmarked portions 42 of tape 38 between consecutive pairs of markers 40, the distances between the leading edges of consecutive markers 40 (i.e. the starting point of consecutive markers 40), the distances between the trailing edges of consecutive markers 40 (i.e. the distances between the ends of consecutive bands of markers 40), or the presence or absence of a marker at predefined regular intervals along the length of the tape 38.

For example, the detector 28 may operate the emission source 44 and sample the marker sensor 46 continuously whilst the controller 24 is effecting movement of the tape 38 (or, rather than continuous sampling, a pre-defined high sampling frequency may be used at pre-determined distances of ribbon travel). By sampling using a continuous or high sampling frequency, information such as approximate marker length l and the spacing between adjacent markers may be obtained. These lengths and separation distances may represent codes having bases other than binary, so as to impart additional information and/or allow a larger range of codes to be represented for a given length of tape 38.

The tape control system either includes, or is communicatively coupled to, a database 29 storing a plurality of codes and associated tape properties. The tape control system identifies one or more properties of the tape 38 on the basis of the identified code, the tape control system then operates in accordance with the identified property or properties. The tape control system is operable to adjust (preferably automatically) one or more settings of the tape drive 11 and/or printing apparatus 10 on the basis of the identified property. Additionally or alternatively, the tape control system is operable to display an error message (such as activating an alarm on a display, displaying a message identifying the error and/or sounding an audible alarm) to a user in the event that a setting of the tape drive 11 or printing apparatus 10 does not match that required by the tape 38, according to the identified property of the tape. The tape control system is able to deactivate the tape drive 11 (i.e. so that the motor control system 25 does not drive the spool supports) if the settings of the printing apparatus 10 or tape drive 11 are not set according to the required settings according to the identified property of the tape.

In embodiments in which the markers 40 on the tape 38 are applied to the tape 38 in such a way that they are not readily detectable to the human eye under normal conditions, for example by the provision of markers 40 including a fluorescent material or other chemical marker that responds to a particular wavelength or polarity of electromagnetic radiation, the markers 40 are only detectable under specific controlled conditions, such conditions being generated inside the housing 13 when the emission source 44 emits that particular type of signal. By reducing the ease with which the markers 40 can be detected, the possibility of counterfeit tape product being produced is reduced, since a person desiring to create a counterfeit tape may not be aware of the presence of the markers. A counterfeit tape which does not include markers, or includes a pattern that does not correspond to the properties of the tape can be detected by the printing apparatus 10.

It is advantageous to detect counterfeit ribbon since counterfeit ribbon may not perform as well as the intended ribbon or may even cause irreversible damage to the printhead 19.

The printing apparatus 10 may react in one or more of the following ways in response to detection of a counterfeit ribbon: generate an alarm to the user; prompt the user for confirmation that the counterfeit ribbon is safe to use; automatically switch the printing apparatus 10 to operate in a restricted manner to limit or prevent damage to the printhead 19; and/or eventually deactivate the motor control system 25 to limit or prevent further damage to the printhead 19.

When incorporated in the ribbon 38, the pattern of markers 40 may be repeated at intervals along the length of the ribbon 38 allowing the ribbon 38 to be identified at any point in its use. This is important since a partially used ribbon spool 15, 17 may be loaded onto the tape drive 11.

Whilst the invention has been described in relation to thermal printing apparatus, it will be appreciated that the tape 38 and detector 28 may be used in relation to other devices or apparatus.

It will be appreciated that the detector 28 of the present invention may be used in conjunction with alternative control systems 25, including other types of motors 16, 18, with or without the need for rotor sensors 20, 22 and that it is not the intention that the present invention should be limited to the particular motor control system 25 described herein.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be used for realising the invention in diverse forms thereof.

The invention claimed is:

1. A tape drive for transferring tape between a first spool and a second spool, the tape including at least one marker indicative of a property of the tape, the tape drive comprising:

two spool supports, each of which is suitable for supporting a spool of tape, and a tape control system for transferring tape between the spools, including a detector that is operable, in use, to detect the presence of a marker on a portion of a tape as the tape is moved past the detector, the tape control system being operable to use information relating to a speed of movement of the tape, as determined by the tape control system, in combination with information obtained by the detector relating to a marker, to identify a property of the tape.

2. A tape drive according to claim 1, wherein the detector is operable to detect a plurality of markers on a tape.

3. A tape drive according to claim 2, wherein the tape control system is operable to identify a pattern of markers on a tape.

4. A tape drive according to claim 3, wherein the tape control system is operable to identify a pattern defined by the presence or absence of markers at predefined intervals on a tape and/or a pattern defined by a length of one or more markers on a tape and/or a pattern defined by spacing between markers on a tape.

5. A tape drive according to claim 3, wherein the tape control system is operable to identify a code corresponding to a pattern of markers detected by the detector.

6. A tape drive according to claim 5, wherein the tape control system is operable to identify a binary code.

7. A tape drive according to claim 5, wherein the pattern of markers includes the presence or absence of markers at predetermined intervals along a portion of a length of the tape.

8. A tape drive according to claim 5, wherein the tape control system is operable to identify a property of the tape based on the identified code.

9. A tape drive according to claim 8, wherein the tape control system comprises a database storing a plurality of codes and associated tape properties.

10. A tape drive according to claim 1, wherein the detector includes:

an emission source configured to emit electromagnetic radiation; and a marker sensor which is configured to receive a signal indicative of whether a marker has responded to emitted radiation, indicating that a marker is present on a tape at a location adjacent the detector.

11. A tape drive according to claim 10, wherein the radiation emitted by the emission source is polarised.

12. A tape drive according to claim 10, wherein the marker sensor is configured to receive a signal that is transmitted, reflected, or emitted by a marker on a tape.

13. A printing apparatus including a tape drive according to claim 1.

14. A tape drive according to claim 1, wherein the tape comprises a pair of opposing surfaces, and a pair of edges disposed on opposing sides of the tape, such that when the tape is wound onto a spool each edge of the tape forms an annular surface; and wherein the at least one marker is provided on at least one of the edges of the tape so as to appear on at least one of the annular surfaces of the tape.

15. A tape for use in a printing apparatus including a tape drive for transferring tape between a first spool and a second spool, the tape comprising:

at least one layer configured and arranged to facilitate use with the tape drive, which includes two spool supports, each of which is suitable for supporting a spool of tape, and a tape control system for transferring tape between the spools, wherein the tape is wound on a core to form a spool for use in the printing apparatus; and a plurality of markers on an edge of the tape, the plurality of markers being provided in radial bands extending between the core and a perimeter of the spool, the plurality of markers being indicative of a property of the tape, and the plurality of markers being configured and arranged to enable detection by a detector of the tape control system as the tape is moved past the detector, wherein the at least one layer comprises an ink layer on a first side, and the tape control system is operable to identify a property of the tape according to a detected marker.

16. A tape according to claim 15, wherein the plurality of markers are also provided on the first, inked side of the tape or the plurality of markers are also provided on a second, non-inked side of the tape.

17. A method of operating a tape drive for transferring tape between a first spool and a second spool, the tape including at least one marker indicative of a property of the tape, the tape drive having (i) two spool supports, each of which is suitable for supporting a spool of tape, and (ii) a tape control system for transferring tape between the spools, including a detector that is operable, in use, to detect the presence of a marker on a portion of a tape as the tape is moved past the detector, the tape control system being operable to identify a property of the tape according to a detected marker, the method comprising:

operating the detector so as to detect the presence of a marker on a portion of the tape;

identifying a property of the tape according to the detected marker in combination with information relating to a speed of movement of the tape, as determined by the tape control system; and operating the tape control system in accordance with the identified property of the tape.

18. A method according to claim 17, wherein operating the detector so as to detect the presence of a marker on a portion of the tape includes repeatedly operating the detector to detect a plurality of markers on a portion of the tape.

19. A method according to claim 17, comprising:

identifying a pattern of markers on the tape; and using information about the movement of the tape provided by the tape control system in combination with the identified pattern to determine a property of the tape.

20. A method according to claim 19, wherein operating the tape control system in accordance with the identified property of the tape includes at least one of adjusting one or more settings of the tape drive, providing an error message, reducing power applied to the printhead to prevent damage, and deactivating the tape drive.

21. A method according to claim 19, wherein operating the tape control system in accordance with the identified property of the tape includes requiring operator intervention to accept a tape type indicated by the identified pattern.

22. A method of operating a tape drive according to claim 17, wherein the tape comprises a pair of opposing surfaces, and a pair of edges disposed on opposing sides of the tape, such that when the tape is wound onto a spool each edge of the tape forms an annular surface; and wherein the at least one marker is provided on at least one of the edges of the tape so as to appear on at least one of the annular surfaces of the tape.

* * * * *